US012392016B2

(12) United States Patent
Flores Renteria

(10) Patent No.: US 12,392,016 B2
(45) Date of Patent: Aug. 19, 2025

(54) ALLOY, POWDER, DUCTILE GAMMA' ADHESION PROMOTER LAYER AND COMPONENT

(71) Applicant: Siemens Energy Global GmbH & Co. KG, Munich (DE)

(72) Inventor: Arturo Flores Renteria, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/750,692

(22) Filed: Jun. 21, 2024

(65) Prior Publication Data

US 2024/0344182 A1 Oct. 17, 2024

Related U.S. Application Data

(62) Division of application No. 18/251,916, filed as application No. PCT/EP2021/077444 on Oct. 5, 2021.

(30) Foreign Application Priority Data

Nov. 5, 2020 (DE) ..... 10 2020 213 918.0

(51) Int. Cl.

| | |
|---|---|
| ***C22C 19/05*** | (2006.01) |
| ***B22F 1/10*** | (2022.01) |
| ***C23C 4/073*** | (2016.01) |
| ***C23C 28/00*** | (2006.01) |

(52) U.S. Cl.

CPC ..... *C22C 19/058* (2013.01); *B22F 1/10* (2022.01); *C23C 4/073* (2016.01); *C23C 28/3215* (2013.01); *C23C 28/3455* (2013.01); *B22F 2301/15* (2013.01); *B22F 2999/00* (2013.01)

(58) Field of Classification Search

CPC ... C22C 19/056; C22C 19/058; C22C 19/055; C22F 1/10; C23C 4/073; C23C 28/3215; B22F 1/10

See application file for complete search history.

(56) References Cited

U.S. PATENT DOCUMENTS

| | | | | |
|---|---|---|---|---|
| 4,885,216 | A | 12/1989 | Naik | C30B 29/52 148/404 |
| 4,909,984 | A | 3/1990 | Singheiser et al. | |
| 6,060,174 | A | 5/2000 | Sabol et al. | |
| 6,482,537 | B1 | 11/2002 | Strangman et al. | |
| 7,422,769 | B2 | 9/2008 | Kassner et al. | |
| 2003/0211356 | A1 | 11/2003 | Beers | C23C 4/073 420/443 |
| 2012/0048912 | A1 | 3/2012 | Hu et al. | |
| 2014/0220384 | A1 | 8/2014 | Stamm | |
| 2014/0234652 | A1 | 8/2014 | Li | |

FOREIGN PATENT DOCUMENTS

| | | | | |
|---|---|---|---|---|
| CN | 103797141 | A | 5/2014 | |
| CN | 108950415 | A | 12/2018 | |
| DE | 3612588 | A1 | 10/1987 | |
| DE | 3842300 | A1 * | 6/1990 | C23C 30/00 |
| DE | 8842301 | A1 | 6/1990 | |
| DE | 60010271 | T2 | 5/2005 | |
| DE | 60103526 | T2 | 6/2005 | |
| DE | 102004034410 | A1 | 2/2008 | |
| EP | 0241807 | A2 | 10/1987 | |

OTHER PUBLICATIONS

Akatsu, T. A. K. A. S. H. I., et al. "Thermal barrier coating made of porous zirconium oxide on a nickel-based single crystal superalloy formed by plasma electrolytic oxidation." Surface and Coatings Technology 223 (2013): 47-51.*

English Abstract and English Machine Translation of Boveri (DE 3842300 A1) (Jun. 21, 1990).*

* cited by examiner

*Primary Examiner* — Jessee R Roe

(74) *Attorney, Agent, or Firm* — Laurence A. Greenberg; Werner H. Stemer; Ralph E. Locher

(57) ABSTRACT

An adhesion promoter layer is produced by a novel composition with a lower cobalt content in an MCrAlY alloy. The adhesion promoter layer leads to a very slow growth of the TGO. The nickel-based alloy contains at least (in wt. %): cobalt (Co) 0.2%-5.0%, chromium (Cr) 14.0%-20.0%; aluminum (Al) 6.0%-8.0%; tantalum (Ta) 1.0%-3.0%; yttrium (Y) 0.3%-0.6%; nickel (Ni) 70.0%-75.0%.

16 Claims, No Drawings

ALLOY, POWDER, DUCTILE GAMMA' ADHESION PROMOTER LAYER AND COMPONENT

CROSS-REFERENCE TO RELATED APPLICATION

This application is a divisional of patent application Ser. No. 18/251,916, filed May 5, 2023, now U.S. Pat. No. 12,129,530, which was a § 371 national stage filing of international application PCT/EP2021/077444, filed Oct. 5, 2021, which designated the United States, this application also claims the priority, under 35 U.S.C § 119, of German patent application DE 10 2020 918.0, filed Nov. 5, 2020; the prior applications are herewith incorporated by reference in their entirety.

FIELD AND BACKGROUND OF THE INVENTION

The invention relates to an alloy, to a powder, to a ductile adhesion promoter layer, and to a component.

The thermomechanical behavior of metallic adhesion promoter layers on substrates has a direct influence on the performance of ceramic thermal barrier coating systems which in the case of turbine components comprise a nickel- or cobalt-based substrate, the adhesion promoter layer, and at least one ceramic layer (TBC) over it.

These metallic adhesion promoter layers have a number of strict criteria to meet, such as protection from oxidation, long-term thermal stability, strength, and ductility.

Particularly for hydrogen turbines, the thermal barrier coating system is subject to a different requirement.

SUMMARY OF THE INVENTION

It is therefore an object of the invention to solve the problem stated above.

The object is achieved by an alloy as claimed in the independent alloy claim, a powder as claimed in the independent powder claim, a layer as claimed in the independent layer claim, and a component as claimed in the independent component claim.

The dependent claims list further advantageous measures, which may be combined with one another as desired in order to achieve further advantages.

The invention comprises a nickel-based alloy, more particularly consisting of (in wt %):

| | |
|---|---|
| cobalt (Co) | 0.2%-5.0%, |
| more particularly | 1.0%-4%; |
| chromium (Cr) | 14.0%-20.0%, |
| more particularly | 16.0%-18.0%; |
| aluminum (Al) | 6.0%-8.0%, |
| more particularly | 7.0%; |
| tantalum (Ta) | 1.0%-3.0%, |
| more particularly | 2.0%; |
| yttrium (Y) | 0.3%-0.6%; |
| nickel (Ni) | 64.0%-79.0%, |
| more particularly | 70.0%-75.0%. |

Notable and necessary is the low cobalt (Co) content.

Impurities are always present in the alloy.

The γ'-containing adhesion promoter layer slows down the growth of the aluminum oxide layer (TGO) and is able as a result to improve the thermal-cyclical lifetime of an overlying ceramic layer (TBC) or coating system (substrate+NiCoCrAl+optionally TBC).

A powder composed of the alloy may optionally comprise binders of other particles such as, in particular, ceramic or refractory particles.

A component, more particularly for a hydrogen-driven gas turbine, comprises a substrate.

The substrate preferably comprises a nickel- or cobalt-based alloy.

Applied atop this is the alloy of the invention, based on NiCoCrAlYTa.

This may be done by means of methods from the prior art, more particularly by means of HVOF and APS.

Likewise conceivable are two-layer NiCoCrAlY protective coats, in which the alloy of the invention preferably forms the outer part.

A TGO forms on this system in operation or as early as during ceramic coating.

A ceramic coating (TBC) on the NiCoCrAlYTa may have a one-layer or two-layer configuration.

Stabilized zirconium oxide preferably constitutes the basis for the TBC.

The invention claimed is:

1. A component, comprising:

a substrate;

a metallic layer formed from a nickel-based alloy or a powder, said nickel-based alloy or said powder each containing (in wt %):

| | |
|---|---|
| cobalt (Co) | 0.2%-5.0%; |
| chromium (Cr) | 14.0%-20.0%; |
| aluminum (Al) | 6.0%-8.0%; |
| tantalum (Ta) | 1.0%-3.0%; |
| yttrium (Y) | 0.3%-0.6%; and |
| nickel (Ni) | 64.0%-79.0%. |

a ceramic thermal barrier layer disposed on said metallic layer.

2. The component according to claim 1, wherein said ceramic thermal barrier layer is based on zirconium oxide.

3. The component according to claim 1, wherein said chromium (Cr) is 14% to 16% (in wt %).

4. The component according to claim 1, wherein said chromium (Cr) is 16% to 18% (in wt %).

5. The component according to claim 1, wherein said chromium (Cr) is 18% to 20 (in wt %).

6. The component according to claim 1, wherein the component is configured for hydrogen-driven gas turbines.

7. The component according to claim 1, wherein said substrate is composed of a nickel-based alloy or a cobalt-based alloy.

8. A component, comprising:

a substrate; and a metallic layer formed from a nickel-based alloy or a powder, said nickel-based alloy or said powder each consisting of (in wt %):

| | |
|---|---|
| cobalt (Co) | 0.2%-5.0%; |
| chromium (Cr) | 14.0%-20.0%; |
| aluminum (Al) | 6.0%-8.0%; |
| tantalum (Ta) | 2.0%; |
| yttrium (Y) | 0.3%-0.6%; and |
| nickel (Ni) | 64.0%-79.0%. |

9. The component according to claim 8, further comprising a ceramic thermal barrier layer.

10. The component according to claim 9, wherein said ceramic thermal barrier layer is based on zirconium oxide.

11. The component according to claim 8, wherein said chromium (Cr) is 14% to 16% (in wt %).

12. The component according to claim 8, wherein said chromium (Cr) is 16% to 18% (in wt %).

13. The component according to claim 8, wherein said chromium (Cr) is 18% to 20 (in wt %).

14. The component according to claim 8, wherein the component is configured for hydrogen-driven gas turbines.

15. The component according to claim 9, wherein said ceramic thermal barrier layer is disposed on said metallic layer.

16. The component according to claim 8, wherein said substrate is composed of a nickel-based alloy or a cobalt-based alloy.

* * * * *